US009309665B2

(12) United States Patent
Riggs

(10) Patent No.: US 9,309,665 B2
(45) Date of Patent: Apr. 12, 2016

(54) RETROFIT CAVITY WALL BARRIER AND METHODS THEREFOR

(71) Applicant: Christopher John Riggs, Dorset (GB)

(72) Inventor: Christopher John Riggs, Dorset (GB)

( * ) Notice: Subject to any disclaimer, the term of this patent is extended or adjusted under 35 U.S.C. 154(b) by 0 days.

(21) Appl. No.: 14/663,837

(22) Filed: Mar. 20, 2015

(65) Prior Publication Data

US 2015/0218800 A1 Aug. 6, 2015

Related U.S. Application Data

(62) Division of application No. 13/822,872, filed as application No. PCT/GB2011/001375 on Sep. 21, 2011.

(30) Foreign Application Priority Data

Oct. 1, 2010 (GB) ..... 1016512.4

(51) Int. Cl.
*E04B 1/70* (2006.01)
*E04F 13/08* (2006.01)

(52) U.S. Cl.
CPC ..... *E04B 1/7038* (2013.01); *E04F 13/08* (2013.01)

(58) Field of Classification Search
CPC ..... E04B 1/7061; E04B 1/4178; E04B 1/644; E04B 1/7038; E04B 1/7612; E04B 1/7637; E04B 1/7675; E04B 2002/565; E04B 1/7308; E04F 13/08
USPC ..... 52/302.1, 302.3, 302.6, 169.5, 379
See application file for complete search history.

(56) References Cited

U.S. PATENT DOCUMENTS 2,934,931 A * 5/1960 Johnson ..... 52/302.3
4,102,093 A * 7/1978 Harris ..... 52/101
4,106,247 A * 8/1978 Svensson ..... E04B 1/7053 52/204.2
4,282,691 A * 8/1981 Risdon ..... 52/101
4,587,891 A * 5/1986 Kruse ..... 454/271

(Continued)

FOREIGN PATENT DOCUMENTS

GB 1566196 A 4/1980
GB 2445223 A 7/2008

OTHER PUBLICATIONS

International Preliminary Report (IPR) Written Opinion mailed date Apr. 11, 2013 for PCT/GB2011/001375.

(Continued)

*Primary Examiner* — James Ference
(74) *Attorney, Agent, or Firm* — Paul D. Bianco; Fleit Gibbons Gutman Bongini & Bianco PL

(57) ABSTRACT

A fitting for a cavity wall within a building includes an elongate member adapted to be supported within the cavity wall. The fitting has two adjacent limbs formed with holes along its length, to allow insulation to pass into an interior of the fitting. Two adjacent limbs form a V-shape channel extending along the top of the fitting when installed, to collect and direct water to the ends of the fitting and out through the boundary wall of the cavity. The fitting has a cross-shaped cross-section, and can be placed in the cavity retrospectively. The cross-shape of the fitting is provided almost flat when dispensed from a reel and when entering the cavity, then springs into the cross-shaped cross-section when the elongate member is straightened in the cavity, to fit tightly within the cavity. The fitting can be inserted into the cavity wall from inside or outside the building.

6 Claims, 3 Drawing Sheets

(56) References Cited

U.S. PATENT DOCUMENTS

| | | | | | |
|---|---|---|---|---|---|
| 4,612,742 | A * | 9/1986 | Bevilacqua | 52/169.5 | |
| 4,852,320 | A * | 8/1989 | Ballantyne | 52/302.3 | |
| 4,907,385 | A * | 3/1990 | Biodrowski | 52/302.3 | |
| 5,230,189 | A * | 7/1993 | Sourlis | 52/169.5 | |
| 5,274,968 | A * | 1/1994 | Pardo | 52/97 | |
| 5,511,351 | A * | 4/1996 | Moore | 52/302.1 | |
| 5,598,673 | A * | 2/1997 | Atkins | 52/302.1 | |
| 5,845,455 | A * | 12/1998 | Johnson, III | E04B 1/7061 | 52/302.6 |
| 5,937,594 | A * | 8/1999 | Sourlis | 52/169.5 | |
| 6,023,892 | A * | 2/2000 | Sourlis | 52/169.5 | |
| 6,044,594 | A * | 4/2000 | Desselle | 52/101 | |
| 6,105,323 | A * | 8/2000 | Paulle | 52/302.1 | |
| 6,256,955 | B1 * | 7/2001 | Lolley et al. | 52/302.3 | |
| 6,474,031 | B2 * | 11/2002 | Phillips | 52/302.1 | |
| 6,883,284 | B1 * | 4/2005 | Burgunder et al. | 52/302.1 | |
| 7,730,685 | B1 * | 6/2010 | Keene | E04B 1/7046 | 52/169.5 |
| 2003/0230035 | A1 * | 12/2003 | Collins et al. | 52/209 | |
| 2004/0003558 | A1 * | 1/2004 | Collins | E04B 1/4178 | 52/302.1 |
| 2004/0111979 | A1 * | 6/2004 | Koehler et al. | 52/23 | |
| 2004/0216416 | A1 * | 11/2004 | Hohmann et al. | 52/513 | |
| 2004/0231259 | A1 * | 11/2004 | Sourlis | 52/302.1 | |
| 2004/0237440 | A1 * | 12/2004 | Paterson et al. | 52/506.01 | |
| 2006/0005490 | A1 * | 1/2006 | Hohmann, Jr. | 52/293.3 | |
| 2006/0117687 | A1 * | 6/2006 | Ehrman et al. | 52/302.1 | |
| 2007/0017175 | A1 * | 1/2007 | Tamlyn | 52/302.4 | |
| 2007/0251171 | A1 * | 11/2007 | Takagi | E04B 1/70 | 52/319 |
| 2008/0141605 | A1 * | 6/2008 | Hohmann | 52/408 | |
| 2009/0019793 | A1 * | 1/2009 | Huber, Jr. | 52/101 | |

OTHER PUBLICATIONS

British Search Report dated Dec. 16, 2010 for GB 1016512.4 (priority app).

International Search Report (ISR) dated Sep. 11, 2011 for PCT/GB2011/001375.

* cited by examiner

RETROFIT CAVITY WALL BARRIER AND METHODS THEREFOR

FIELD OF THE INVENTION

The present invention relates to modification of buildings with high exposure to driving rain, where the cavity wall barrier is fitted retrospectively.

BACKGROUND OF THE INVENTION

In a building which comprises one or more levels or floors of flats (apartments) the outer walls of the buildings are usually formed as a cavity wall defining a space between inner and outer leaves of the wall which space generally extends from top of the building to the bottom.

BRIEF DESCRIPTION OF THE DRAWINGS

In order that the invention may be more readily understood reference will now be made to the accompanying drawings, in which.

DETAILED DESCRIPTION OF THE INVENTION

Figure 1:
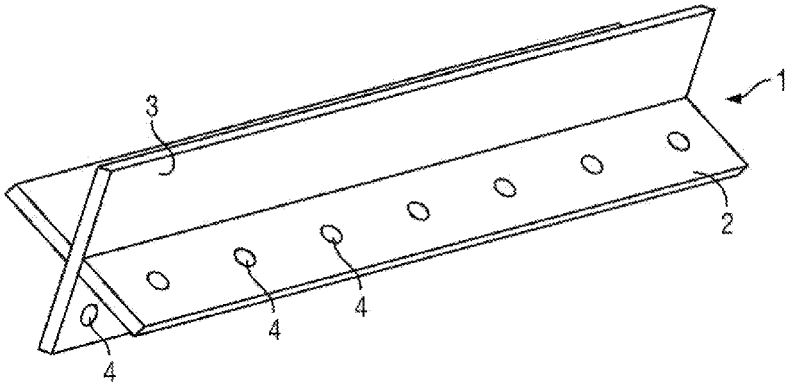
FIG. 1 is a schematic perspective view of a fitting according to the invention.

In a building which comprises one or more levels or floors of flats (apartments) the outer walls of the buildings are usually formed as a cavity wall defining a space between inner and outer leaves of the wall which space generally extends from top of the building to the bottom. The space in the cavity walls can be retro filled with insulating material.

It is desirable to prevent any water and/or small pieces of mortar from mixing with the insulating material.

The portions of the outer cavity wall, which coincide with each level of flats can be selectively filled with insulation or left empty depending on the wish of the occupant/owner of each level of flats.

According to the first aspect of the invention, a fitting for retrospective installation in a cavity wall comprises an elongate member for installation within the cavity, the member being of cruciform cross section, having four limbs extending from a centre, two adjacent ones of the four limbs each having a row of holes formed therein to allow passage of insulation material into the spaces formed between each holed limb and its respective other adjacent limb, the two other adjacent limbs being adapted to form the top of the fitting when installed, so that they form a V-shaped channel to collect water and channel it to the end of the fitting and away from the cavity.

The elongate member that is adapted to extend across the cavity the arrangement being such that water in the cavity above the fitting is collected in the limbs V-shaped channel at the top of the fitting. This provides a barrier across the cavity.

The elongate member may preferably be of plastic, but could be metal.

The member may not, or maybe incline with respect to the leaves of the cavity wall. This provides for a positive action in collecting water.

The cruciform may be provided on a reel (FIG. 5), thereby rendering the cross-section of the device initially virtually flat, until upon insertion within the cavity, the fitting springs out into its final cruciform shape as it is straightening inside the cavity space, whereupon it adapts itself to fit tightly within the cavity, rather than it being supplied in a predetermined width for fitting in the cavity. Further, it fits tightly to the cavity walls when sliding to its final position in the cavity space.

The holes may be uniformly spaced apart along the length of the two elongate adjacent limbs. The holes provide access for insulation to fill the spaces in the cruciform.

A set of parts may comprise a fitting as hereinbefore defined, and a support means or supporting the fitting in position in the cavity.

A building may comprise a cavity wall and a fitting as hereinbefore defined installed in the cavity.

There may be a plurality of said fittings spaced just above or just below each floor line over the height of the cavity. This provides for water collection at each floor line, and the catching of small bits of mortar over the height of the cavity.

One or each fitting may be supported in the cavity from below by a plurality of support means, comprising a pin or shaft extending transversely of the cavity, suitably, the pin or shaft made of metal.

There may be insulation material in the cavity, which can be supported in place in the cavity by the fitting.

Where the building is a multi-occupancy apartment building, the insulation materials may be coincident with a discrete apartment. Thus one or more other apartments may not have insulation material in the cavity at the level of that one or other apartment(s).

The member fitting may be adapted to hold the insulating material in position in the cavity.

The fitting may be adapted to prevent relatively small pieces of mortar from falling onto the insulation.

A drain at each end of the fitting ejects the collected water in the top of the cruciform; this drain releases the water through the boundary wall to the outside of the cavity wall.

Figure 2:
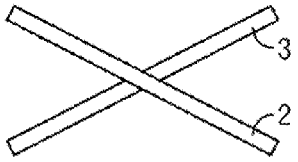
FIG. 2 is a schematic end view of the fitting illustrated in FIG. 1.

With reference to FIGS. 1 and 2, the fitting 1 comprises elongate member 2 and 3 in the form of a plastic or metal structure with a cruciform cross section as clearly illustrated in FIG. 2. One member 2 is formed with one row of holes 4 extending along its length while the other member 3 is formed with one row of holes 4. The holes 4 are approximately 15 mm in diameter at approximately 150 mm centers. Fitting 1 fits tightly across a cavity (see FIG. 3).

Figure 3:
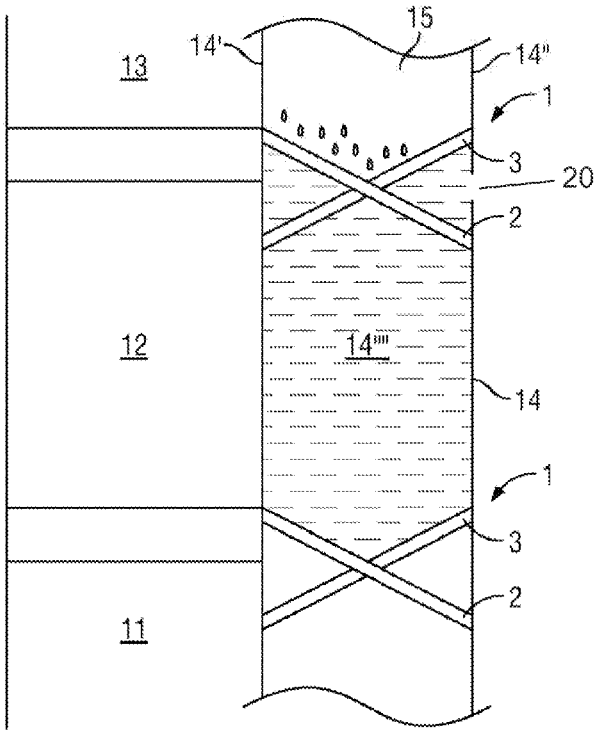
FIG. 3 is a diagrammatic view of a building containing several floors/levels of flats (apartments) and an out cavity wall and showing the fitting illustrated in FIGS. 1 and 2 in position in the cavity wall.

FIG. 3 illustrates diagrammatically a building having several levels of flats (apartments) 11, 12 and 13 extending between cavity walls one of which is illustrated at 14 and which has inner 14' and outer 14" leaves, defining a cavity 14"" therebetween. The cavity wall 14"" is adapted to be filled with insulation material 15 at a later stage. For example, the occupants of flat 12 may want cavity wall insulation material whereas the occupants of flats 11 and 13 may not want the insulation material.

The fittings 1 is adapted to be fitted into the cavity by making a hole 20 in the inner or outer wall and inserting the fitting in one or both directions to spring tightly into cavity 14"". The spaces between the fittings 1 may be filled with insulating material or left empty as required.

The fittings 1 are designed to operate as follows:

If water falls down within the cavity wall it will fall into the top of the fitting and will collect in the top of member 2 and member 3 and then flow to the end of the fitting and out through the boundary wall of the cavity wall, and being directed away from the cavity 14"" by fitting 1.

If any loose material falls down within the cavity wall, it will fall into and be retained by the top (as viewed) FIG. 4, and will not contaminate or form a bridge on the top of any insulating material positioned below the fitting.

Figure 4:
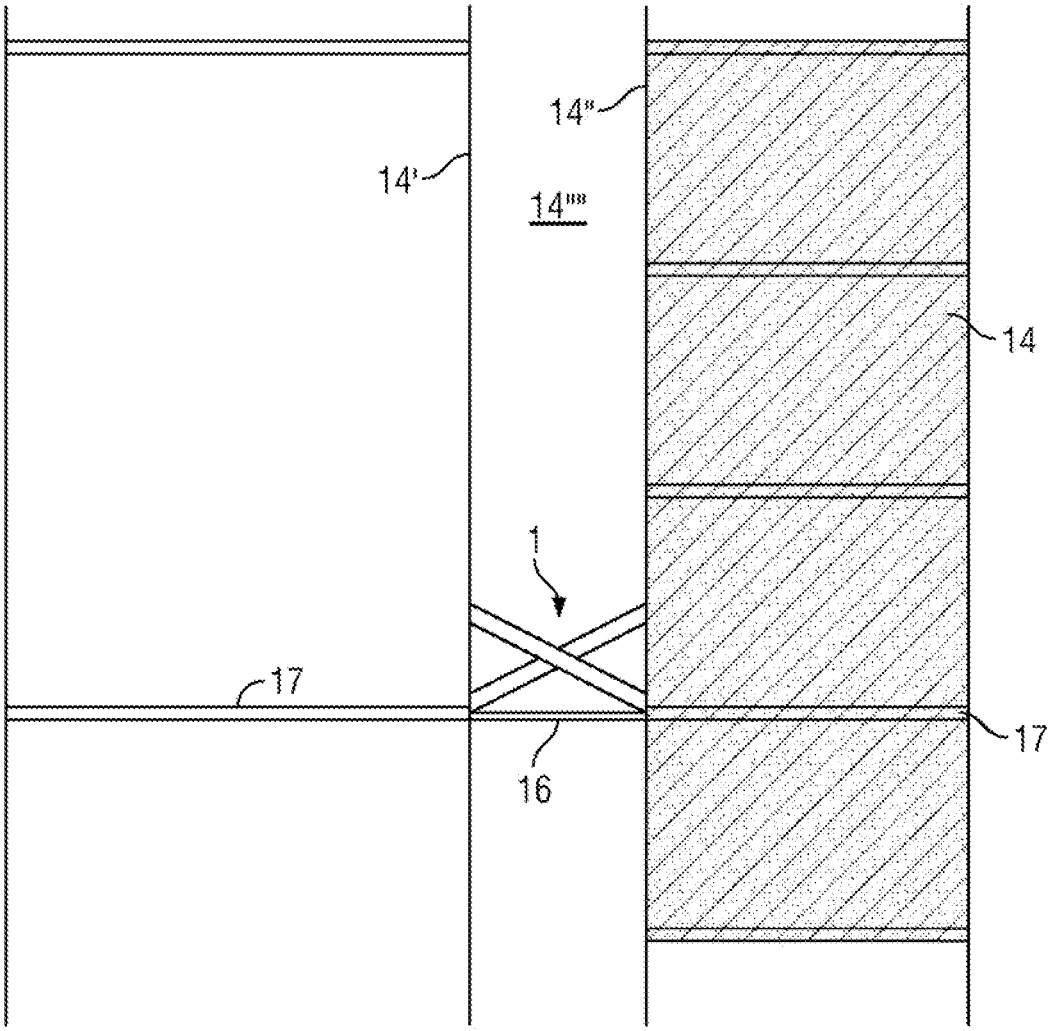
FIG. 4 shows a schematic view of a further embodiment of fitting according to the invention installed in the cavity wall, with the collected water.

With reference to FIG. 4, in which like parts are indicated by reference numerals, there is for a fitting 1 support means 16 in the form of a pin or shaft (of metal in the embodiment) which extends transversely of the cavity 14"" and is mounted at each end in the mortar 17 of the respective leaves 14', 14" of the cavity wall 14. The support means 16 is a rod, pin or shaft of metal, galvanized or of stainless steel, and supports the fitting 1 as by that fitting resting on it in the cavity 14"

Figure 5:
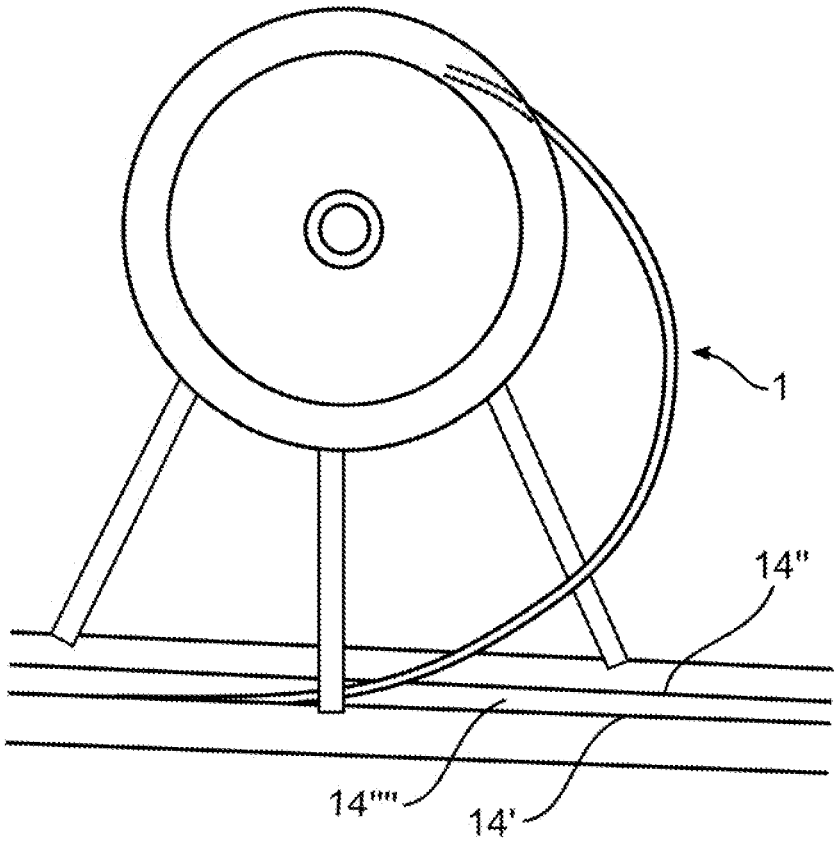
FIG. 5 shows a schematic view of the fitting entering the cavity from a reel.

FIG. 5 shows fitting 1 on a reel entering cavity 14"".

It will be understood that reference to "water" herein includes liquid water and water vapor in the cavity, that condenses to form liquid water in the cavity.

It is also understood that the fitting as hereinbefore described with reference to the drawings may be incorporated in an existing cavity wall, retrospectively.

The invention claimed is:

1. A method of controlling water accumulation in a cavity formed between adjacent first and second walls, comprising:

a. providing a flexible elongate cross-shaped member defining first, second, third, and fourth longitudinally extending limbs which form a cross of the cross-shaped member and which are mutually joined along a central longitudinal axis of the member, each of the first, second, third, and fourth limbs having a longitudinally extending free end, each of the first and second limbs being adjacent relative to each other, and each provided with apertures spaced apart along a longitudinal axis of the member, wherein each of the apertures has a diameter of approximately 15 mm to allow passage of insulating material, each of the third and fourth limbs being adjacent relative to each other, and each not provided with apertures and defining a water retaining V-shaped channel therebetween, each of the first and second limbs configured to spring out to move relatively closer or further apart, each of the third and fourth limbs configured to spring out to move relatively closer or further apart, the first and third limbs resiliently pressable against the first wall when the flexible elongate cross-shaped member is inserted in the cavity between the first and second walls, and the second and fourth limbs resiliently pressable against the second wall when the flexible elongate cross-shaped member is inserted in the cavity between the first and second walls, wherein the elongate member resiliently springs into the cruciform cross section when the elongate member is straightened;

b. inserting the flexible elongate cross-shaped member in the cavity between the adjacent first and second walls, the third and fourth upper adjacent limbs facing upwards relative to a ground, and the first and second lower limbs facing downwards relative to the ground;

c. engaging the first wall by resiliently pressing the first and third limbs against the first wall when the flexible elongate cross-shaped member is inserted in the cavity between the adjacent first and second walls;

d. engaging the second wall by resiliently pressing the second and fourth limbs against the second wall when the flexible elongate cross-shaped member is inserted in the cavity between the adjacent first and second walls; and e. maintaining a position of the flexible elongate cross-shaped member in the cavity between the adjacent first and second walls with the resilient pressing of the first and third limbs against the first wall and the resilient pressing of the second and fourth limbs against the second wall, wherein the cavity has a width defined by a distance between the adjacent first and second walls and the position of the flexible elongate cross-shaped member in the cavity is maintained for a range of cavity widths.

2. The method of claim 1, further comprising making a hole in one of the adjacent first and second walls through which the flexible elongate cross-shaped member is to be inserted.

3. The method of claim 1, further comprising unrolling the elongate member from a reel, with the flexible elongate cross-shaped member flattened on the reel and resiliently springing into shape as the flexible elongate cross-shaped member is unrolled from the reel.

4. The method of claim 1, further comprising inserting one or more pins or shafts extendable transversely between the first and second walls to support the flexible elongate cross-shaped member when the member is inserted between the adjacent first and second walls.

5. The method of claim 1, further comprising collecting water in the retaining V-shaped channel and channeling the collected water from between the adjacent first and second walls to outside of at least one of the first and second walls.

6. The method of claim 5, further comprising introducing insulating material through the apertures of the first limb to the space formed between the first and third limbs and through the apertures of the second limb to the space formed between the second and fourth limbs.

* * * * *